US007287591B2

(12) United States Patent
Campbell

(10) Patent No.: US 7,287,591 B2
(45) Date of Patent: Oct. 30, 2007

(54) PRIMARY ELECTRO-MECHANICAL INITIATING DUMP BAILER DEVICE AND METHOD OF USE

(76) Inventor: Tony Campbell, 108 Midland Dr., Houma, LA (US) 70360

( * ) Notice: Subject to any disclaimer, the term of this patent is extended or adjusted under 35 U.S.C. 154(b) by 343 days.

(21) Appl. No.: 10/986,593

(22) Filed: Nov. 12, 2004

(65) Prior Publication Data

US 2006/0102336 A1 May 18, 2006

(51) Int. Cl.
*E21B 43/00* (2006.01)
*E21B 23/00* (2006.01)
*E21B 33/12* (2006.01)

(52) U.S. Cl. ..... 166/305.1; 166/381; 166/66.4; 166/162

(58) Field of Classification Search ..... 166/65.1, 166/305.1, 373, 381, 66.4, 162, 169, 177.4, 166/110
See application file for complete search history.

(56) References Cited

U.S. PATENT DOCUMENTS 2,591,807 A 4/1952 Greene
2,689,008 A 9/1954 Allen et al.
2,696,258 A 12/1954 Greene
2,725,940 A 12/1955 Shidell et al.
3,187,813 A 6/1965 Greene
3,208,521 A 9/1965 Holland et al.
3,318,393 A 5/1967 Brown
3,379,251 A * 4/1968 Bohn ..... 166/286
4,696,343 A 9/1987 Anderson et al.
4,739,829 A * 4/1988 Brunner ..... 166/63
6,041,857 A * 3/2000 Carmody et al. ..... 166/66.4
6,543,532 B2 * 4/2003 Estep et al. ..... 166/66.4

* cited by examiner

*Primary Examiner*—David Bagnell
*Assistant Examiner*—Shane Bomar

(57) ABSTRACT

Electro-mechanically initiated dump bailer devices are disclosed generally comprising a top assembly and one or more bottom assemblies, the top assembly having a means for transferring electrical power from a surface power supply through the top end of the assembly, a reversible motor coupled to the top section and capable of receiving electrical power from the top end, the motor having a rotational output shaft, a rotational means for transferring work from the rotational output shaft to the one or more bottom assemblies that cause the setting of material into the zone of interest. In addition, methods of using the electro-mechanically initiated bump bailer devices are also disclosed.

53 Claims, 7 Drawing Sheets

PRIMARY ELECTRO-MECHANICAL INITIATING DUMP BAILER DEVICE AND METHOD OF USE

FIELD OF THE INVENTION

This invention relates in general to an apparatus, commonly referred to as a bump bailer, which allows various materials, such as, sand, gravel, cement, plastic, etc., to be set in a zone of interest by applying power from a surface power supply. More specifically, the apparatus of the current invention eliminates the need for explosive agents used in conventional dump bailing systems.

BACKGROUND OF THE INVENTION

In an oil and gas wells, there are occasions when it is desired to set material into a zone of interest within a wellbore. This can be done by lowering what is commonly referred to as a dump bailer into the wellbore on tubing or wireline.

It is well-known in the oil well drilling and production arts to use cement or other materials, for various well operations such as, for example, to seal off a certain formations below a production packer so that other producing zones can be perforated. Typically, the dispensing of cement or other materials into the well bore is done using a device known in the industry as a "dump bailer." Older conventional dump bailers were gravity operated, using a very large weight which falls under the force of gravity to dispense any contained material into the bore. The problem with these types of device is that they often fail to fully dispense the material as desired requiring multiple trips and additional expense to the well operation.

More modern conventional dump bailers use explosive components to generate pressure to actuate the device and dispense material into the bore. However, premature actuation of the explosive components is of particular concern with downhole devices. Some common sources that can cause premature actuation include careless application of power to cable conductors, stray electrical currents from power generators, cathodic protection systems, lightning or static, and extraneous radio frequency energy. In addition to premature actuation, the misfiring or failure of a downhole explosive component to detonate presents another particular concern. The hazard associated with a misfired device is magnified by the possibility that an operator retrieving the device may not know that the device has not detonated.

The present invention provides an improvement over prior art type dump bailers by providing a dump bailer which uses a surface electrical power source to move a piston, which fully dispenses the cement or other product into the well bore. The use of a surface power supply as described herein is an improvement over prior art type dump bailers which rely upon gravity to pull a piston or dispensing member downwardly, or relies upon the use of an explosive component that generates pressure to move a piston.

Some examples of prior art devices include, U.S. Pat. No. 2,696,258, entitled "Oil Well Cementing Packer," which discloses a cementing packer wherein a charge is exploded to drive the cement from the bailer. The device uses a vertically elongated container with a body of cement contained in the container. A gas generated charge displaces the cement through a lower outlet in the container into the well bore. The device is further characterized by a bore sealing mechanism which is adapted to expand by cement displacing gases to plug the well bore above the zone being cemented, and thus seal the bore against upward dissipation of the force of the gases.

U.S. Pat. No. 2,591,807, entitled "Oil Well Cementing," discloses an apparatus for depositing cement in a zone within a well bore. The apparatus further includes a vertically elongated container to be lowered into the well bore zone and containing a body of cement, a relatively high velocity explosive charge in the lower portion of the container and serving upon ignition to cavitate the well bore at the zone. A relatively lower velocity explosive charge in the container above the body of cement serves upon ignition to force cement downwardly and outwardly into the cavity and a fuse for igniting the charges extends first to the high velocity charge and then to the lower velocity charge so as to ignite the charges in that order.

U.S. Pat. No. 3,187,813, entitled "Apparatus for Depositing Cement or the Like in a Well," provides a tool assembly to be lowered into a well on a flexible line and includes a container having a massive cementitious material therein. An opening is provided at the lower portion of the container which can be opened while in the well and thereby allow cementitious material to flow downwardly from the container and into the well by gravity. The assembly is constructed to avoid the application of the cementitious material with any other displacing forces other than gravity during the downward flow so that the cementitious material after leaving the container may seek its own level in the well by gravity.

U.S. Pat. No. 3,208,521, entitled "Recompletion of Well," discloses a method of forming a plug in a well pipe including the steps of anchoring a support member at a given level in the pipe, depositing a quantity of liquid cementitious mixture on the support member, inserting a conductive metal rod in the cementitious mixture so that the rod extends substantially through the cementitious mixture and is substantially centrally located on the longitudinal axis of the well pipe. After the cementitious mixture has hardened for at least a period of two hours, an electrical direct current is passed from the well pipe to the rod through the hardened cementitious mixture until there has passed at least fifty coulombs of electricity per square inch of contact between the pipe and the cementitious mixture.

U.S. Pat. No. 2,689,008, entitled "Method for Cementing Well," provides a method for cementing a well having a perforated casing therein, which comprises locating a body of hydraulic cementitious material in the perforated casing in the region of and adjacent the perforations and locating a high explosive detonating charge in the body of the cementitious material. The charge is discharged and at least a portion of the cementitious material is forced through the perforations thereby dehydrating and setting the portions of cementitious material to seal the perforations.

U.S. Pat. No. 2,725,940, entitled "Dump Bailer for Well," discloses a dump bailer for wells including a tubular body, a closure for its upper end including an attachment to a lowering cable, a filler opening in the wall of the body adjacent the closure, a tubular sleeve coaxially connected to the lower end of the body, a removable plug closing lower into the sleeve, and the downwardly facing annular shoulder in the bore of the sleeve axially spaced from the plug, the sleeve having a discharge passage through the wall thereof between the shoulder and the plug, a tubular frangible liner is coaxially positioned in the bore of the sleeve opposite the passage and having one end abutting the shoulder and the other end abutting the plug, an annular resilient seal is disposed to form a fluid type seal between the liner and the wall of the sleeve at points above and below the passage thereby to close off the passage. An electrically fired explosive charge positioned in the bore of the liner is provided and the cable provides a means for firing the charge so as to shatter the liner and open the passage.

U.S. Pat. No. 3,379,251, entitled "Dump Bailer," discloses a dump bailer for depositing material in a well bore. The apparatus includes a reservoir section formed of a length of flexible tubing, a bottom plug closing one end of the reservoir section, a supporting head having a lower portion to which the upper end of the reservoir section is attached, and an upper portion mechanically attaching a wireline cable for positioning the dump bailer in the well bore, and means to fill the reservoir with a material to be deposited. A squeegy is formed of two spaced apart rollers, attached together by crossbars and secured to the upper end of the flexible tubing forming the reservoir section. A pair of pivotally spring loaded fingers are attached to the crossbars for engaging the walls of the bore hole upon any upward movement of the dump bailer so that the squeegy remain stationary and then as the dump bailer is moved upward, the pressure on the bottom of the reservoir is increased ejecting the bottom plug and then positively depositing the material in the reservoir.

U.S. Pat. No. 3,318,393, entitled "Formation Treatment," describes a wireline apparatus for treating a permeable earth formation zone containing a formation fluid under pressure and traversed by a case bore hole containing a column of fluid extending upwardly of the zone providing a hydrostatic pressure environment within the casing greater than the pressure of formation fluid. The apparatus includes a body adapted to be lowered within the bore hole by means of a wireline, a perforator including explosive material disposed on the body for perforating the casing along a predetermined axis to establish fluid communication with the formation therebeyond when the explosive material is fired, a compartment in the body providing a volume of low pressure gas of a size to contain any gases evolving from the explosive material when fired at a pressure less than the pressure of the formation fluid, a sealing mechanism on the body for isolating the fluid communication from the hydrostatic pressure environment of the bore hole by sealing off an isolated area of the casing wall when urged thereagainst.

SUMMARY OF THE INVENTION

Accordingly, electro-mechanically initiated dump bailer devices are disclosed generally comprising a top assembly and a bottom assembly, the top assembly having a means for transferring electrical power from a surface power supply through the top end of the assembly, a motor coupled to the top section and capable of receiving electrical power from the top end, the motor having a rotational output shaft, a means for transferring work from the rotational output shaft to the bottom assembly that causes the dumping of material into the zone of interest. In addition, methods of using the electro-mechanically initiated bump bailer devices are also disclosed.

Considering the top assembly in more detail, the top assembly comprises a means for reversing the operation of the connected motor. In one embodiment, the means for reversing the operation of the motor comprises a particular wiring arrangement connecting the top end of the top assembly to the motor that consists of the positive lead from the surface power supply connected to a contact in the top end that is wired to the positive terminal of the connected DC motor and the negative lead of the surface power supply wired through the top end of the top assembly and directly to the negative terminal of the connected DC motor. With this arrangement and by reversing the polarity of the surface power supply, the motor may be operated in two directions resulting in either the clockwise or counterclockwise rotation of the motor's rotational output shaft. The top assembly further comprises a upper window assembly for receiving the material to be set in the zone of interest from the surface.

Considering the means for transferring work from the rotational output shaft to the bottom assembly that causes the dumping of material into the zone of interest in more detail, a preferred embodiment comprises a primary lead screw, having a externally threaded surface, and mechanically coupled to the rotational output shaft of the motor, and a secondary lead screw capable of rotationally engaging the externally threaded surface of the primary lead screw and designed such that as the primary lead screw rotates, the secondary lead screw moves in an axial direction. The secondary lead screw has a lower externally threaded portion that couples to one or more extension rods via a threaded connector. The last of the one or more extension rods is coupled to the bottom assembly. As the lower externally threaded portion of the secondary lead screw moves in one axial direction, thereby also axially moving the extension rod(s), the bottom assembly is actuated and material located between the top assembly and bottom assembly is dumped into a zone of interest within the wellbore. As the lower externally threaded portion moves in the opposite axial direction, the operation of the bottom assembly is reversed, thereby resealing the bottom assembly and allowing the space between the top assembly and bottom assembly of the device to be filled with additional or, if desired a new material to be set in the zone of interest.

Considering the bottom assembly in more detail, in one embodiment the bottom assembly comprises a top sealing sub having a sealed piston coupled to a lower window assembly. Prior to actuation of the bottom section and dumping of a material into a zone of interest, the sealed piston prevents the material to be set in a zone of interest from flowing into and through the lower window assembly into the zone of interest. Upon actuation of the bottom section, the sealed piston is pushed down into the lower window assembly by the one or more extension rods thereby breaking the seal between the sealed piston and bottom assembly and allowing material located above the top sealing sub to enter and flow through the windows of the lower window assembly and into the zone of interest. Finally, a bull nose is disposed below the lower window assembly for contacting a subsurface valve. Whereas the bull noses employed in conventional dump bailers have been used to enable the operation of the device, the bull nose here is intended only to guide the assemblies into position above a subsurface valve and does not effect operation of the disclosed devices.

PREFERRED EMBODIMENTS OF THE INVENTION

In the following detailed description of the preferred embodiments, reference is made to the accompanying drawings that form a part hereof, and in which are shown by way of illustration specific embodiments in which the invention may be practiced. It is to be understood that other embodiments may be utilized and structural changes may be made without departing from the scope of the present invention.

Figure 1:
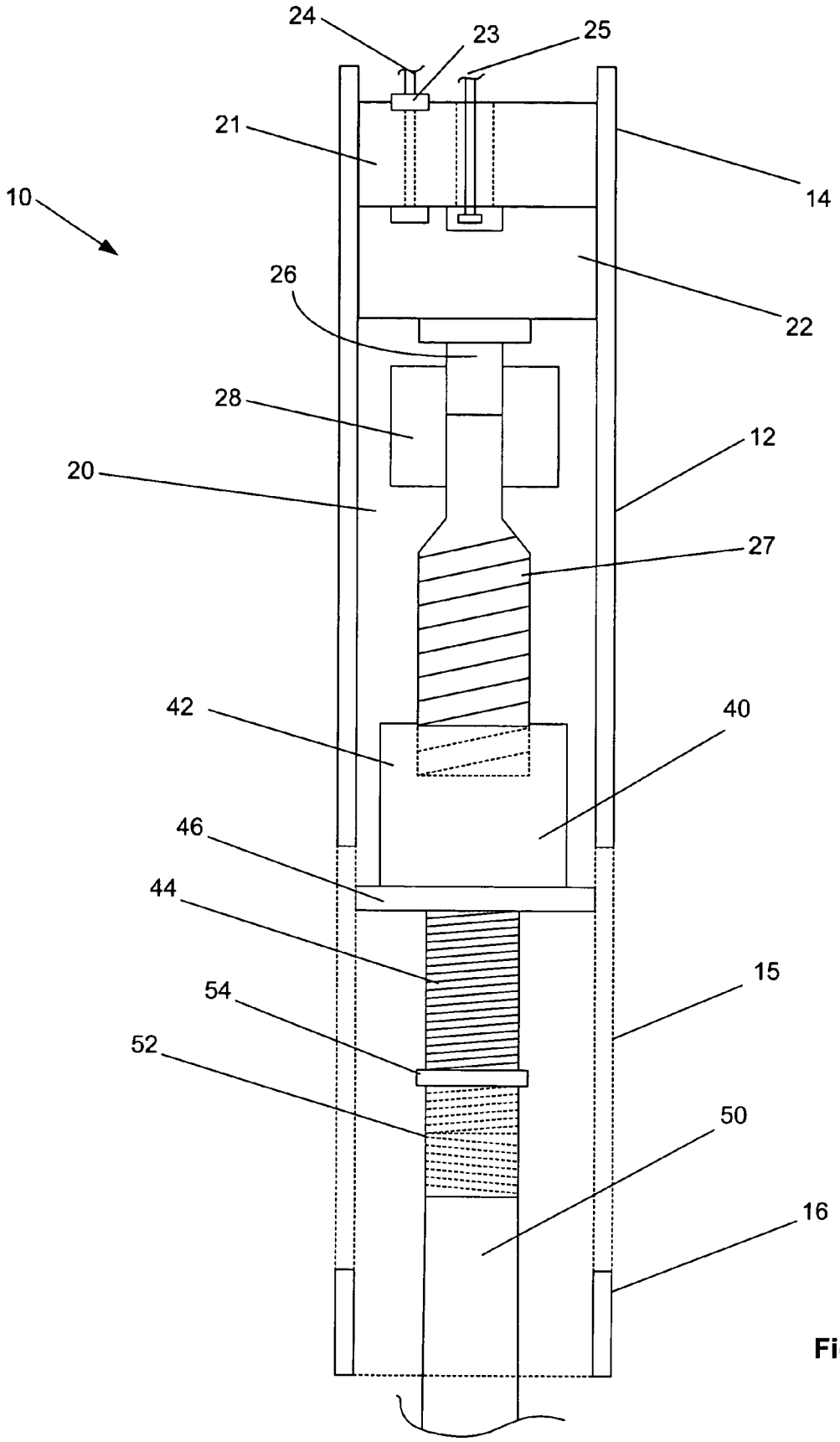
FIG. 1 is a cross sectional view of the top assembly featuring the top end, motor, shaft, primary lead screw, secondary lead screw, and extension rod(s).

As shown in FIG. 1, one preferred embodiment of the top section of the electro-mechanically initiated bump bailer device, is illustrated generally as 10 and comprises a generally tubular housing 12 having a top end 14 and a bottom end 16. The top end 14 mates with an electrical connection sub (not shown). The bottom end 16 comprising an upper window assembly 15 that allows materials that will fill the dump bailer to enter into the apparatus from the tubing string above.

The generally tubular housing 12 of the top assembly 10 generally comprises a cylindrical hollow bore 20 defined therethrough. Disposed within the bore 20 are the several electrical connection component parts needed to transfer power from the electrical connection sub above to the motor 22 within the top assembly 10. The top end 12 of the top assembly 10 further comprises an insulator 21. Insulator 21 may be constructed of any suitable electrical insulating material, for example a phenolic resin such as polyetheretherketone resin (PEEK). On the top side of insulator 21, a brass contact 23 is provided for the connection of positive lead 24 from the surface power supply through the electrical connection sub disposed above. The negative lead 25 from the surface power supply is routed through insulator 21 and is wired directly to motor 22 by conventional means. The wiring to motor 22 allows the motor to be operated in two directions, clockwise and counterclockwise, depending on the polarity of the surface power supply. That is, a negative polarity surface power supply causes the motor to turn in the clockwise direction, resulting in actuation of the dump bailer device and the setting of the material contained therein, while a positive polarity surface power supply causes the motor to turn counterclockwise, resulting in a reversal of the actuation of the dump bailer device and the filling of material within the dump bailer device prior to deployment downhole. The process by which the bump bailer device is actuated and filled is described in further detail below.

The size (voltage and torque requirements) of the motor 22 employed in the disclosed device depends upon the service application; however, any size motor may be adapted for use in the disclosed devices. As shown in FIG. 1, the motor 22 is connected to a rotational output shaft 26. Rotational output shaft 26 is in turn coupled to primary lead screw 27 via coupling apparatus 28. The coupling of apparatus 28 may be performed by any conventional means, such as a pin that traverses the primary lead screw 27 and rotational output shaft 26.

Motor 22 begins to turn once current is transferred from the electrical connection sub above through insulator 21. As output shaft 26 rotates, primary lead screw 27 also rotates as work is transferred to primary lead screw 27 through coupling device 28.

Primary lead screw 27 is threadably engaged to secondary lead screw 40. Secondary lead screw 40 comprises an upper portion having an internal female threaded connection 42 and a male threaded lower portion 44. The female threaded upper portion 42 engages with primary lead screw 27 and a comprises a guide ring 46 that is secured within assembly 10. Assembly 10 and guide ring 46 cooperate to prevent rotation of the upper portion 42 of the secondary lead screw 40. Rather, rotation of primary lead screw 27 within the upper portion of secondary lead screw 40 causes the lower portion 44 of secondary lead screw 40 to extract upward or extend downward, depending on the polarity of the surface power supply to motor 22.

The male threaded connection 44 of secondary lead screw 40 is coupled to one or more extension rods 50 via an internally threaded connector 52. Locking nut 54, which is screwed onto secondary lead screw 40 prior to the engagement of connector 52, limits the axial motion of secondary lead screw 40.

Figure 2:
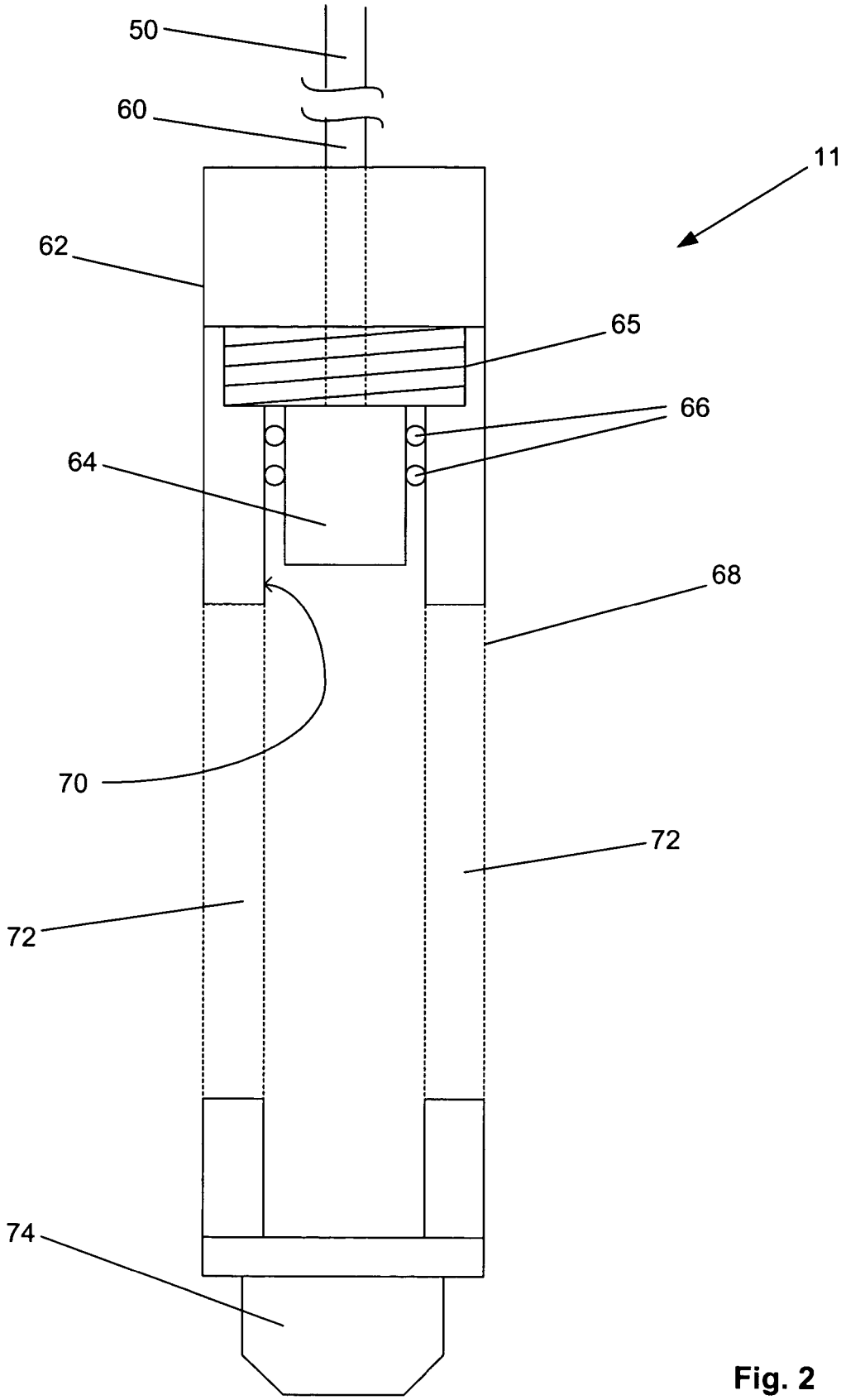
FIG. 2 is a cross sectional view of the bottom assembly featuring the sealing sub with sealed piston, the bottom window assembly and a bull nose sub.

Referring now to FIG. 2, bottom assembly 11 is shown in greater detail. Traversing downward, the one or more extension rods 50 terminate some distance below the top assembly 10. The bottom end 60 of the last extension rod 50 is coupled to sealing sub 62. Within sealing sub 62, the bottom end 60 of extension rod 50 is mechanically coupled to sealed piston 64. Sealed piston 64 is fitted with a plurality of o-ring seal 66 that seal the piston 64 against the inner wall of bottom window assembly 68. Sealing sub 62 is coupled to bottom window assembly 68 via a threaeded engagement 65.

As stated above, motor 22 in top assembly 10 may be operated in two directions, clockwise and counterclockwise, depending on the polarity of the surface power supply. With regard to bottom assembly 11, when a negative polarity surface power supply is delivered to motor 22, the motor 22 turns in the clockwise direction, resulting in the rotation of primary lead screw 27 and the extension of secondary lead screw 40 and the downward axial motion of extension rod(s) 50. The downward axial motion of extension rod(s) 50 causes the sealed piston 64 to move downward into the bottom window assembly 68. Once the sealed piston 64 moves below the sealing surface 70 of the bottom window assembly 68, any material that has been placed above the bottom assembly 11 will then be allowed to flow through sealing sub 62, into bottom window assembly 68, and into a zone of interest via windows 72.

Once the material has been set into the zone of interest from the dump bailer apparatus, the polarity of the surface power feeding motor 22 can be reversed. By reversing the polarity of the surface power supply, the motor 22 will rotate in a counterclockwise direction, which will also rotate the primary lead screw 27 in a counterclockwise direction that will cause the secondary lead screw 40 to retract. The extraction of secondary lead screw 40 will cause the upward axial motion of extension rod(s) 50 and will pull sealed piston 64 from bottom window assembly 68 and back into contact with sealing surface 70. Once sealed, the dump bailer apparatus of the present invention may be refilled with the same material, or a different material if desired, which can be run into the zone of interest in a similar manner to that described above without necessitating the removal of the dump bailer apparatus from the well bore.

Finally, as shown in FIG. 2, a bull nose assembly 74 is disposed below the bottom window assembly for contacting a subsurface valve (not shown). Whereas the bull noses employed in conventional dump bailers have been used to enable the operation of the device, the bull nose here is intended only to guide the assemblies into position above a subsurface valve and does not effect operation of the disclosed devices.

Figure 3:
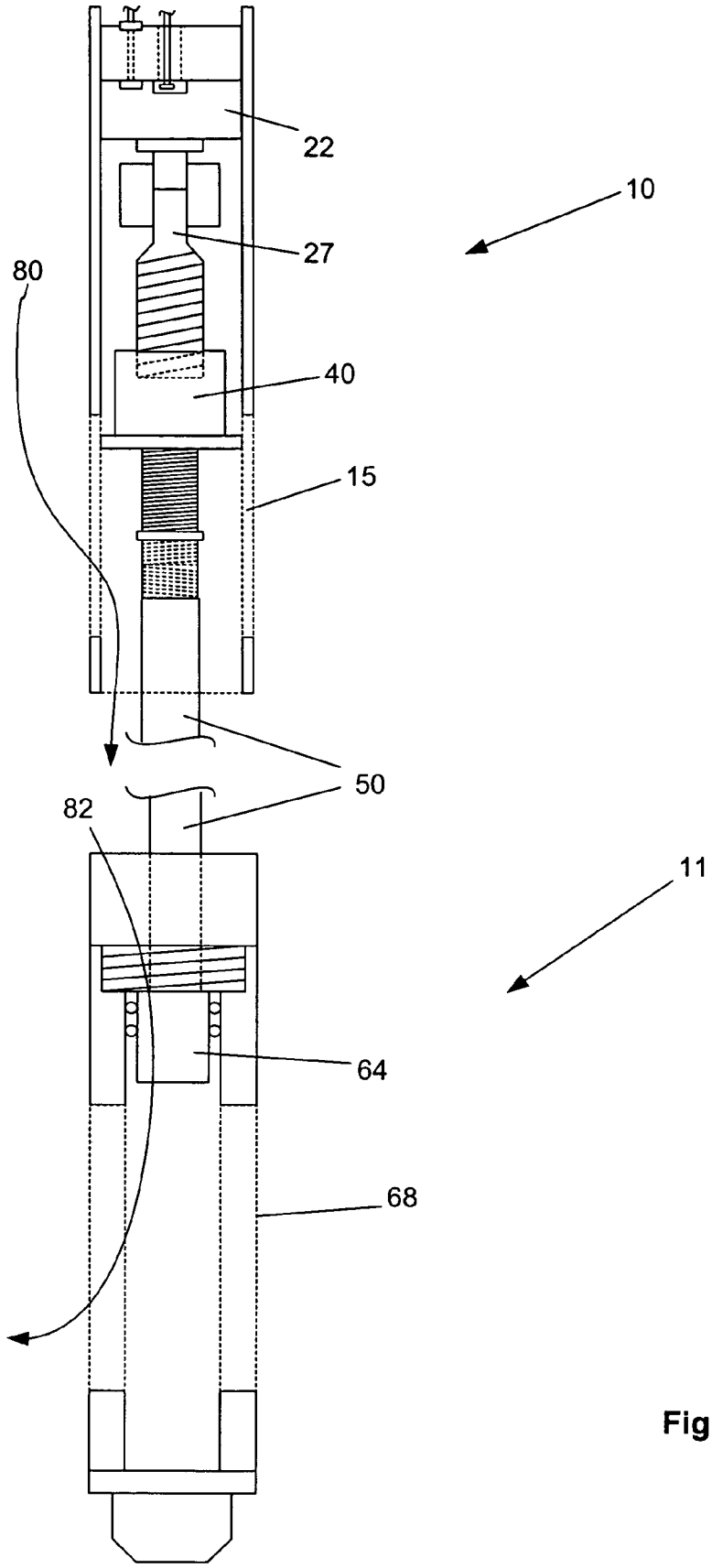
FIG. 3 illustrates one preferred embodiment of the complete dump bailer assembly.

FIG. 3 illustrates the connection of the top assembly 10 and the bottom assembly 11 via extension rod(s) 50. The flow path of material that will be set into a zone of interest is also shown in FIG. 3. Material, such as sand, cement, gravel, etc., would be pumped down form the surface where it will come into contact with the present invention through the use of appropriate overhead equipment. With sealed piston 64 in its sealed position within bottom window assembly 68, the material from the surface is pushed into top window assembly 15 as can be seen by flow path 80. The material cannot be pumped down further into the bottom window assembly as long as sealed piston 64 remains in a sealed position. After motor 22 receives power, primary lead screw 27 rotates, and secondary lead screw extends downward in an axial direction, the sealed piston 64 drops and allows material from above to exit the dump bailer apparatus via flow path 82. Note that a packer device disposed above the zone of interest would prevent the upper flow of material after exiting the dump bailer apparatus.

Figure 4:
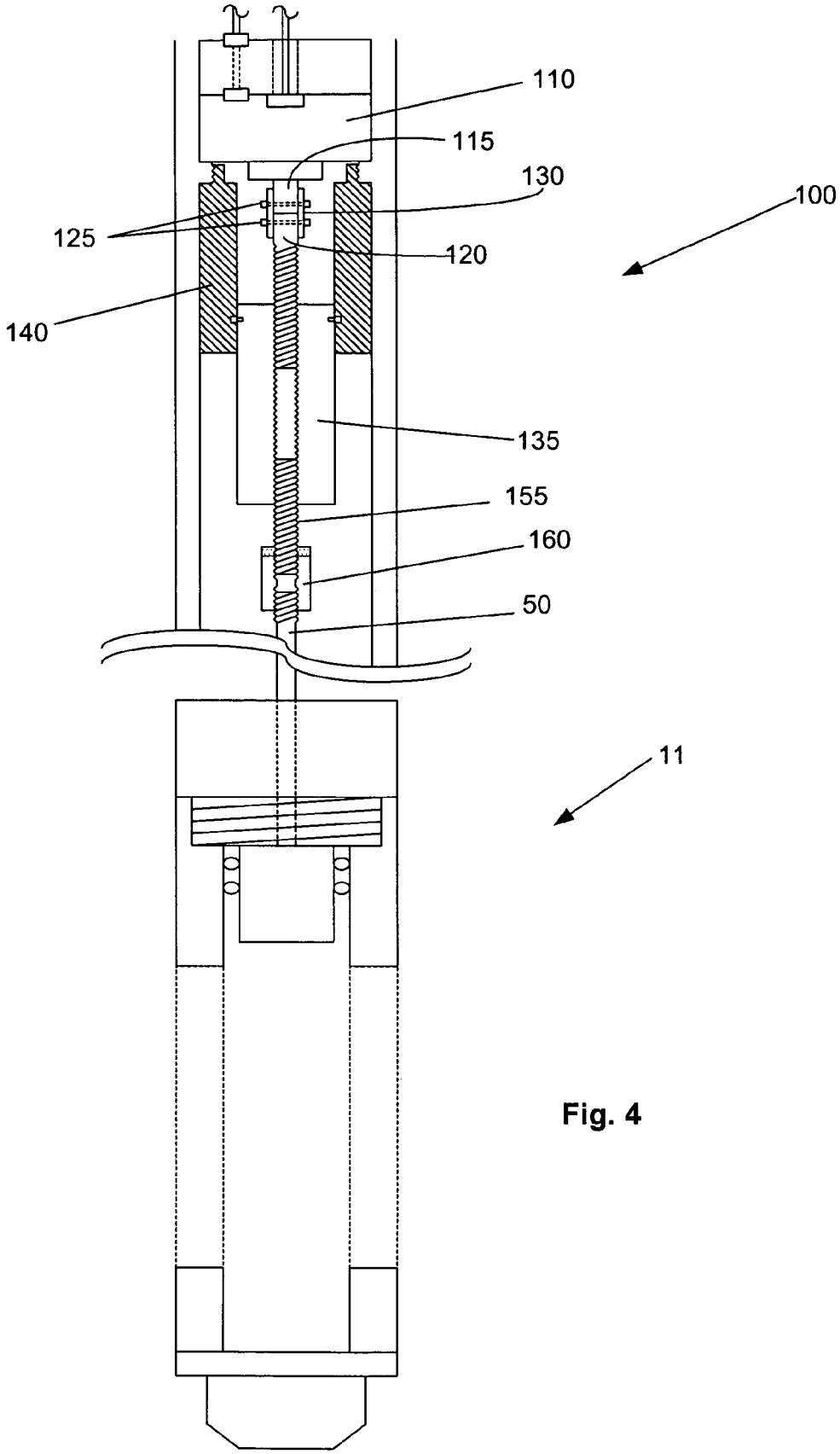
FIG. 4 is a cross sectional view of the top and bottom assemblies featuring another preferred embodiment of the secondary lead screw.

FIG. 4 illustrates another preferred embodiment of the top assembly 100 coupled to the bottom assembly 11. Motor 110 has a rotational output shaft 115 that is coupled to the primary lead screw 120. The rotational output shaft 115 and the upper end of primary lead screw 120 are cylindrical, have non-threaded surfaces, and have a bore defined therethrough to accept pins 125. Retaining collar 130 is a coupling device fitting over the rotational output shaft 115 and the upper end of primary lead screw 120. Pins 125 secure both the rotational output shaft 115 and the upper end of primary lead screw 120 to retaining collar 130, such that as rotational output shaft 115 turns, work is transferred through retaining collar 130 to primary lead screw 120.

The lower portion of primary lead screw 120 has a male threaded surface, which is theadingly engaged with secondary lead screw 135. Secondary lead screw 135 has a cylindrical body having bore defined therethrough, a non-threaded outer surface, and a female threaded inner surface within its bore. As primary lead screw 120 turns within secondary lead screw 135, secondary lead screw 135 moves in an axial direction with respect to primary lead screw 120. Mechanical guide cage 140 prevents secondary lead screw 135 from rotating as primary lead screw 120 turns. The operation of the mechanical guide cage 140 is best shown in FIG. 5.

Figure 5:
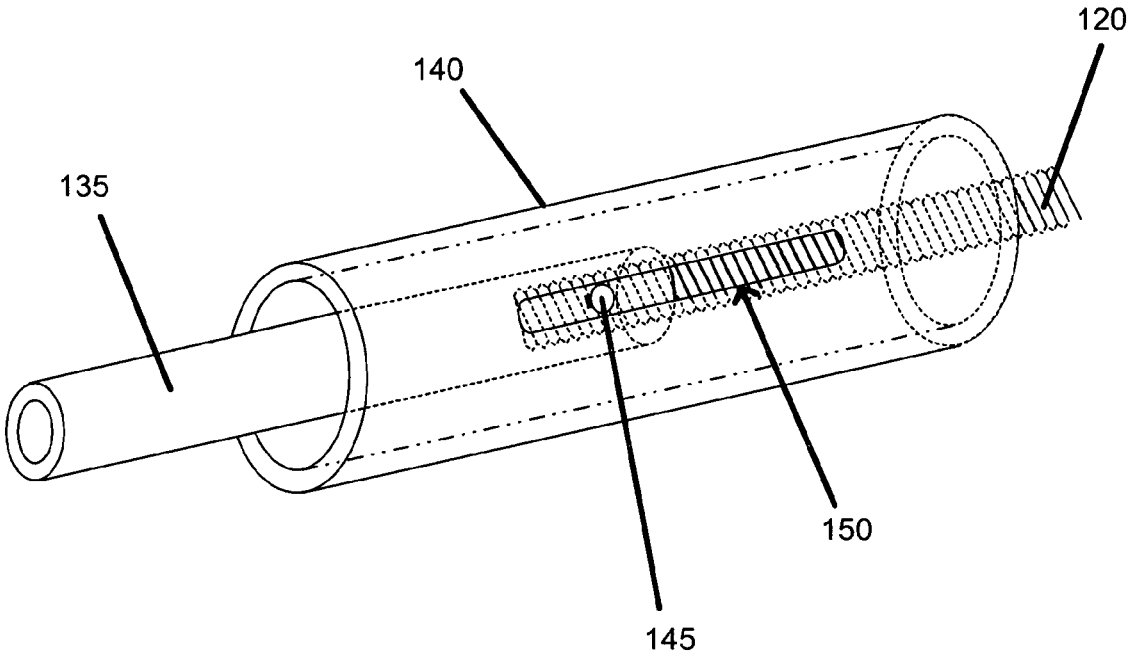
FIG. 5 is a perspective view of the primary lead screw and the secondary lead screw shown in communication with the mechanical guide cage.

As shown in FIG. 5, guide screws 145, which are connected to the outer surface of secondary lead screw 135, extend into window portions 150 of mechanical guide cage 140. As stated above, mechanical guide cage 140 is secured to the electromechanical housing (not shown) thus cannot rotate. As primary lead screw 120 turns, guide screws 145 prevent the rotation of secondary lead screw 135 and causes secondary lead screw 135 to move axially.

Referring back to FIG. 4, a male threaded extension 155 is connected to the bottom end of secondary lead screw 135. As the secondary lead screw 135 moves in an axial direction, it also moves extension 155 in the same axial direction. Threaded connection 160 connects extension 155 to extension rod 50 similar to the embodiments described above.

Figure 6:
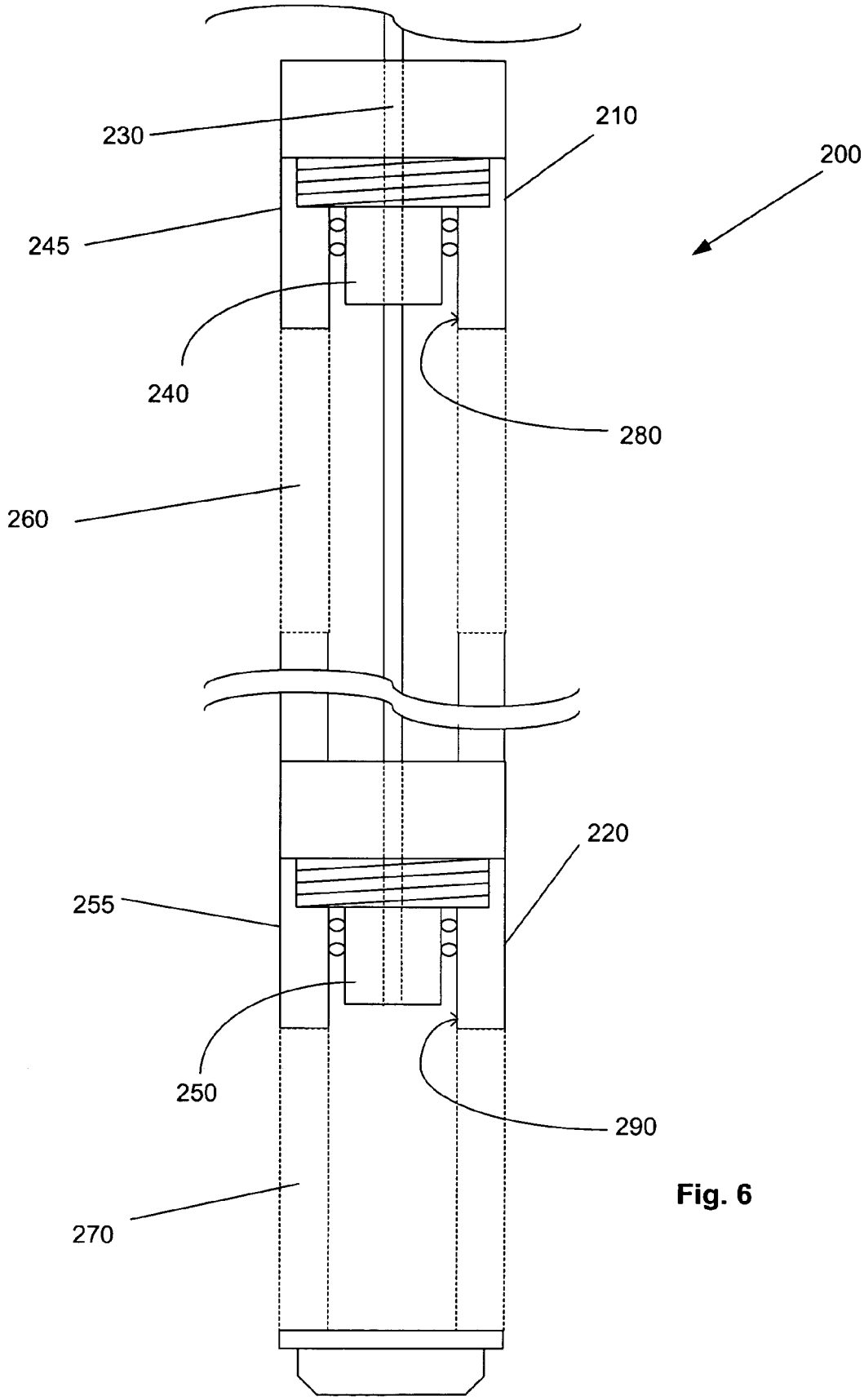
FIG. 6 is a cross sectional view of another preferred embodiment of the bottom assembly featuring two dump bailers.

FIG. 6 illustrates another preferred embodiment of the bottom assembly featuring two or more dump bailers connected in series. In this embodiment, two different materials can be run into a zone of interest either simultaneously or consecutively. As shown in FIG. 6, bottom assembly 200 comprises two are more dump bailers connected in series. For illustration purposes, bottom assembly 200 is shown having an upper dump bailer 210 and a lower dump bailer 220. The dump bailers may be connected by any conventional means and are preferably secured by threaded connections. Extension rod 230 is connected to the top assembly (not shown) as described above. Extension rod 230 is coupled to sealed piston 240 of the upper dump bailer 210 and is coupled to sealed piston 250 of the lower dump bailer 220. As the secondary lead screw of the top assembly moves downward by operation of the motor in the top assembly, the extension rod 230 also moves downward. By appropriately positioning the sealed pistons 240, 250 within sealing subs 245, 255, the downward motion of extension rod 230 will push sealed piston 240 into the window section 260 of upper dump bailer 210 and sealed piston 250 into the window section 270 of lower dump bailer 220 either simultaneously or consecutively. Once clear of sealing surfaces 280, 290, the sealed pistons 240, 250 allow the material held inside the upper dump bailer 210 and the lower dump bailer 220 to exit the window sections 260, 270 of their respective dump bailers and into the zone of interest.

Figure 7:
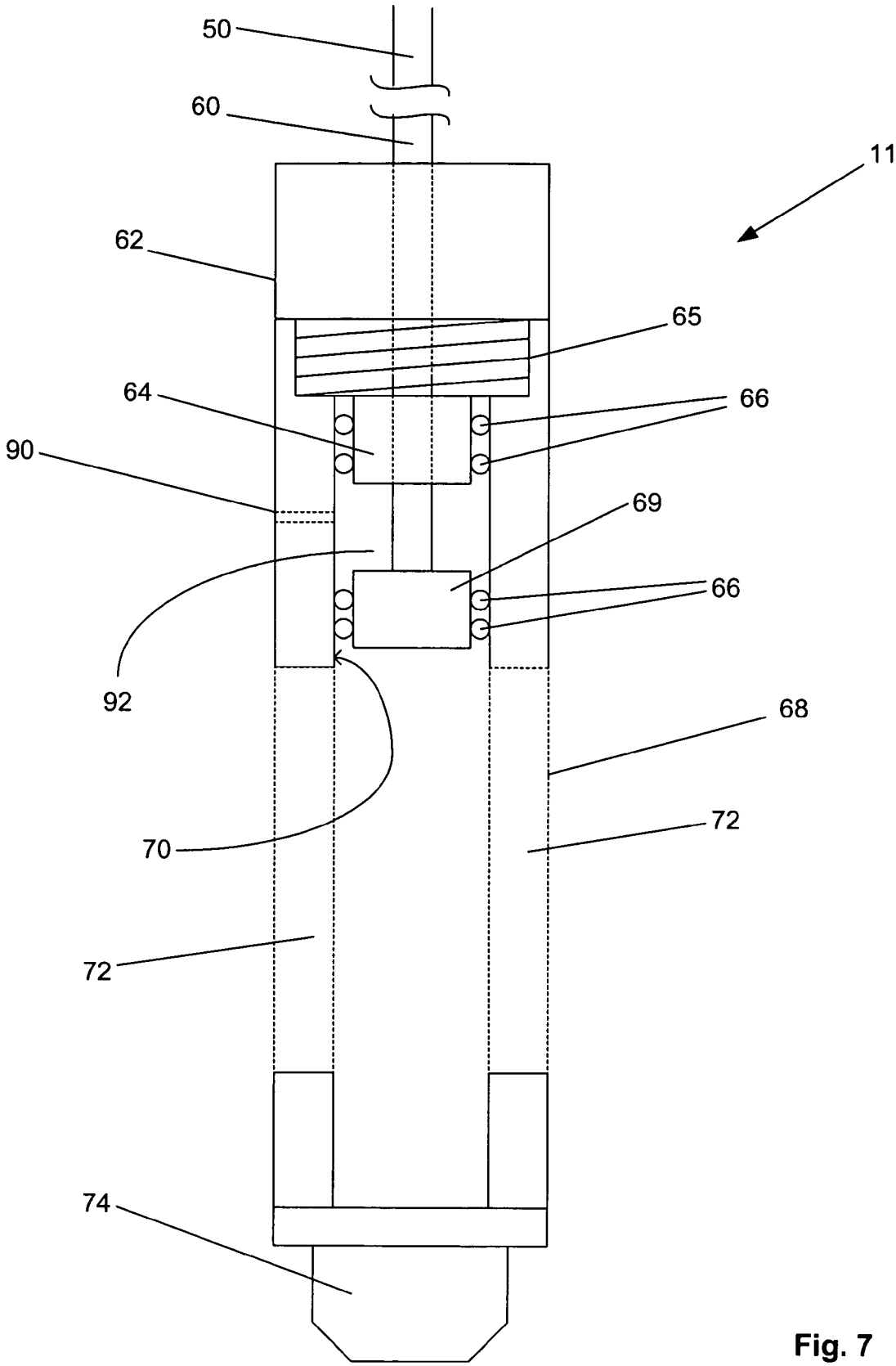
FIG. 7 is a cross sectional view of another preferred embodiment of the bottom assembly featuring a double sealing sub for injecting small volumes of material into a zone of interest.

FIG. 7 illustrates another preferred embodiment of the bottom assembly featuring a double sealing sub for injecting small volumes of material into a zone of interest, for example when it is desired to deliver radioactive material to a zone of interest. The bottom assembly operates similarly to the embodiments described above, however, the dump bailer does have any material stored above the sealing sub 62. Rather, injection port 90 is employed to load the bailer via an injection syringe prior to deployment downhole and the small volume of material is stored between sealed piston 64 and sealed piston 69. As described above, when the secondary lead screw in the top assembly (not shown) moves downward, it pushes both sealed pistons 64 and 69. Once sealed piston 64 is clear of sealing surface 70, the material stored between sealed pistons 64 and 69 is allowed to flow through windows 72 into the zone of interest.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. An apparatus for setting material into a zone of interest within a wellbore, the apparatus comprising:

a top section having a means for transferring electrical power from a surface power supply through the top section;

a reversible motor coupled to the top section and capable of receiving electrical power from the top section, the motor having a rotational output shaft;

a bottom section having a top portion and a bottom portion, the top portion comprising a sealing member sealing the top portion from the bottom portion;

a reversible means for transferring work from the rotational output shaft to the bottom section capable of moving the sealing member from the top portion of the bottom section into the bottom portion of the bottom section thereby breaking the seal between the top portion and the bottom portion and allowing material to be set within a zone of interest, as well as being capable of moving the sealing member from the bottom portion of the bottom section into the top portion of the bottom section thereby sealing the top portion from the bottom portion after material has been set within a zone of interest;

wherein the top section further comprises a tubular body having a bore defined therethrough and the means for transferring electrical power through the top section comprises an insulating member disposed within the bore of the tubular body, the insulating member having an electrical contact that connects to a positive lead from the surface power supply and a bore therethrough for passage of a negative lead of the surface power supply, and wherein the reversible motor further comprises a positive terminal and a negative terminal that are connected to the electrical contact and the negative lead, respectively;

wherein the reversible motor rotates in one direction with the application of the surface power supply of a given polarity and rotates in the opposite direction with the application of the surface power supply of an opposite polarity; and wherein the reversible means for transferring work from the rotational output shaft to the bottom section comprises a primary lead screw mechanically coupled to the rotational output shaft of the motor, the primary lead screw having a externally threaded surface, a secondary lead screw having a upper portion comprising a substantially cylindrical body having a bore defined therethrough with an internally threaded surface capable of rotationally engaging the externally threaded surface of the primary lead screw, a bottom portion having an externally threaded surface, the bottom portion coupled to the upper portion such that when the primary lead screw rotates in one direction within the upper portion, the bottom portion of the secondary lead screw moves in an axial direction and when the primary lead screw rotates in the opposite direction within the upper portion, the bottom portion of the secondary lead screw moves in the opposite axial direction, and a coupling means connecting the bottom portion of the secondary lead screw to the bottom section such that the axial motion of the bottom portion in one direction moves the sealing member from the top portion of the bottom section into the bottom portion of the bottom section and the axial motion of the bottom portion in the opposite direction moves the sealing member from the bottom portion of the bottom section into the top portion of the bottom section.

2. The apparatus of claim 1, wherein the reversible means for transferring work from the rotational output shaft to the bottom section further comprises a plurality of extension rods connecting the bottom portion of the secondary lead screw to the bottom section which maintains a volume of space between the top section and bottom section for holding the material to be set within a zone of interest.

3. The apparatus of claim 2, wherein the tubular body of the top section further comprises a plurality of windows through which the material to be set within a zone of interest is transferred from the surface through the plurality of windows and into bore of the tubular body.

4. The apparatus of claim 3, wherein the bottom section further comprises a tubular body having a bore defined therethrough, the tubular body having a top portion and a bottom portion, the top portion of the tubular body housing the sealing member.

5. The apparatus of claim 4, wherein the sealing member comprises a cylindrical piston that seals against the inner surface of the top portion of the tubular body.

6. The apparatus of claim 5, wherein the sealing member further comprises a plurality of o-rings for maintaining the seal between the sealing member and the inner surface of the top portion of the tubular body.

7. The apparatus of claim 6, wherein the bottom portion of the bottom section further comprises a plurality of windows through which the material to be set within a zone of interest is transferred from above the bottom section through the top portion, into the bore of the tubular body of the bottom section, and through the plurality of windows into the zone of interest.

8. The apparatus of claim 7, further comprising a bull nose disposed below bottom section for guiding the placement of the apparatus into a wellbore.

9. An apparatus for setting material into a zone of interest within a wellbore, the apparatus comprising:

a top section having a means for transferring electrical power from a surface power supply through the top section;

a reversible motor coupled to the top section and capable of receiving electrical power from the top section, the motor having a rotational output shaft;

a bottom section having a top portion and a bottom portion, the top portion comprising a sealing member sealing the top portion from the bottom portion;

a reversible means for transferring work from the rotational output shaft to the bottom section capable of moving the sealing member from the top portion of the bottom section into the bottom portion of the bottom section thereby breaking the seal between the top portion and the bottom portion and allowing material to be set within a zone of interest, as well as being capable of moving the sealing member from the bottom portion of the bottom section into the top portion of the bottom section thereby sealing the top portion from the bottom portion after material has been set within a zone of interest;

wherein the top section further comprises a tubular body having a bore defined therethrough and the means for transferring electrical power through the top section comprises an insulating member disposed within the bore of the tubular body, the insulating member having an electrical contact that connects to a positive lead from the surface power supply and a bore therethrough for passage of a negative lead of the surface power supply, and wherein the reversible motor further comprises a positive terminal and a negative terminal that are connected to the electrical contact and the negative lead, respectively;

wherein the reversible motor rotates in one direction with the application of the surface power supply of a given polarity and rotates in the opposite direction with the application of the surface power supply of an opposite polarity; and wherein the reversible means for transferring work from the rotational output shaft to the bottom section comprises a primary lead screw mechanically coupled to the rotational output shaft of the motor, the primary lead screw having an externally threaded surface; a secondary lead screw comprising a cylindrical body having a top end, a bottom end, and a bore defined therethrough, the bore having an internally threaded surface, the top end of the cylindrical body capable of engaging the primary lead screw, and the bottom end coupled to the sealing member; and a guide cage in communication with the external surface of the secondary lead screw, the guide cage capable of preventing rotation of the secondary lead screw as the primary lead screw rotates causing the secondary lead screw to move in an axial direction as the primary lead screw rotates and the axial motion of the secondary lead screw causing axial motion of the sealing member.

10. The apparatus of claim 9, wherein the reversible means for transferring work from the rotational output shaft to the bottom section further comprises a plurality of extension rods connecting the bottom end of the secondary lead screw to the bottom section which maintains a volume of space between the top section and bottom section for holding the material to be set within a zone of interest.

11. The apparatus of claim 10, wherein the bottom section further comprises a tubular body having a bore defined therethrough, the tubular body having a top portion and a bottom portion, the top portion of the tubular body housing the sealing member.

12. The apparatus of claim 11, wherein the sealing member comprises a cylindrical piston that seals against the inner surface of the top portion of the tubular body.

13. The apparatus of claim 12, wherein the sealing member further comprises a plurality of o-rings for maintaining the seal between the sealing member and the inner surface of the top portion of the tubular body.

14. The apparatus of claim 13, wherein the bottom portion of the bottom section further comprises a plurality of windows through which the material to be set within a zone of interest is transferred from above the bottom section through the top portion, into the bore of the tubular body of the bottom section, and through the plurality of windows into the zone of interest.

15. The apparatus of claim 14, further comprising a bull nose disposed below bottom section for guiding the placement of the apparatus into a wellbore.

16. An apparatus for setting a first and second material into a zone of interest within a wellbore, the apparatus comprising:

a top section having a means for transferring electrical power from a surface power supply throuah the top section;

a reversible motor coupled to the top section and capable of receiving electrical power from the top section, the motor having a rotational output shaft;

a first bottom section having a top portion and a bottom portion, the top portion comprising a sealing member sealing the top portion from the bottom portion;

a second bottom section disposed below the first bottom section, the second bottom section having a top portion and a bottom portion, the top portion comprising a sealing member sealing the top portion from the bottom portion;

a reversible means for transferring work from the rotational output shaft to the first and second bottom sections capable of moving the sealing members from the top portions of the bottom sections into the bottom portions of the bottom sections thereby breaking the seals between the top portions and the bottom portions and allowing material to be set within a zone of interest, as well as being capable of moving the sealing members from the bottom portions of the bottom sections into the top portions of the bottom sections thereby sealing the top portions from the bottom portions after material has been set within a zone of interest;

wherein the top section further comprises a tubular body having a bore defined therethrough and the means for transferring electrical power through the top section comprises an insulating member disposed within the bore of the tubular body, the insulating member having an electrical contact that connects to a positive lead from the surface power supply and a bore therethrough for passage of a negative lead of the surface power supply, and wherein the reversible motor further comprises a positive terminal and a negative terminal that are connected to the electrical contact and the negative lead, respectively;

wherein the reversible motor rotates in one direction with the application of the surface power supply of a given polarity and rotates in the opposite direction with the application of the surface power supply of an opposite polarity; and wherein the reversible means for transferring work from the rotational output shaft to the first and second bottom sections comprises a primary lead screw mechanically coupled to the rotational output shaft of the motor, the primary lead screw having an externally threaded surface; a secondary lead screw comprising a cylindrical body having atop end, a bottom end, and a bore defined therethrough, the bore having an internally threaded surface, the top end of the cylindrical body capable of engaging the primary lead screw, and the bottom end coupled to the sealing members; and a guide cage in communication with the external surface of the secondary lead screw, the guide cage capable of preventing rotation of the secondary lead screw as the primary lead screw rotates causing the secondary lead screw to move in an axial direction as the primary lead screw rotates and the axial motion of the secondary lead screw causing axial motion of the sealing members.

17. The apparatus of claim 16, wherein the reversible means for transferring work from the rotational output shaft to the first and second bottom sections further comprises a plurality of extension rods connecting the bottom end of the secondary lead screw to the first bottom section which maintains a volume of space between the top section and first bottom section for holding the first material to be set within a zone of interest and one or more extension rods connecting the sealing member of the first bottom section to the sealing member of the second bottom section which maintains a volume of space between to first bottom section and the second bottom section for holding the second material to be set within a zone of interest.

18. The apparatus of claim 17, wherein the first and second bottom sections further comprise a tubular body having a bore defined therethrough, the tubular bodies having a top portion and a bottom portion, the top portion of the tubular bodies housing the sealing members.

19. The apparatus of claim 18, wherein the sealing members comprise a cylindrical piston that seals against the inner surfaces of the top portions of the tubular bodies.

20. The apparatus of claim 19, wherein the sealing members further comprise a plurality of o-rings for maintaining the seal between the sealing members and the inner surfaces of the top portions of the tubular bodies.

21. The apparatus of claim 20, wherein the bottom portions of the bottom sections further comprise a plurality of windows through which the first and second materials to be set within a zone of interest is transferred from above the bottom sections through the top portions, into the bore of the tubular bodies of the bottom sections, and through the plurality of windows into the zone of interest.

22. The apparatus of claim 21, further comprising a bull nose disposed below the second bottom section for guiding the placement of the apparatus into a wellbore.

23. An apparatus for setting material into a zone of interest within a wellbore, the apparatus comprising:

a top section having a means for transferring electrical power from a surface power supply through the top section;

a reversible motor coupled to the top section and capable of receiving electrical power from the top section, the motor having a rotational output shaft;

a bottom section having a top portion and a bottom portion, the top portion comprising a first and second sealing member sealing the top portion from the bottom portion and maintaining a space between the first and second sealing member for holding the material to be set within a zone of interest;

a reversible means for transferring work from the rotational output shaft to the bottom section capable of moving the sealing members from the top portion of the bottom section into the bottom portion of the bottom section thereby breaking the seal between the top portion and the bottom portion and allowing the material held between the first and second sealing member to be set within a zone of interest, as well as being capable of moving the sealing members from the bottom portion of the bottom section into the top portion of the bottom section thereby sealing the top portion from the bottom portion after the material has been set within a zone of interest.

24. The apparatus of claim 23, wherein the top section further comprises a tubular body having a bore defined therethrough and the means for transferring electrical power through the top section comprises an insulating member disposed within the bore of the tubular body, the insulating member having an electrical contact that connects to a positive lead from the surface power supply and a bore therethrough for passage of a negative lead of the surface power supply, and wherein the reversible motor further comprises a positive terminal and a negative terminal that are connected to the electrical contact and the negative lead, respectively.

25. The apparatus of claim 24, wherein the reversible motor rotates in one direction with the application of the surface power supply of a given polarity and rotates in the opposite direction with the application of the surface power supply of an opposite polarity.

26. The apparatus of claim 25, wherein the bottom section further comprises a tubular body having a bore defined therethrough, the tubular body having a top portion and a bottom portion, the top portion of the tubular body housing the sealing members.

27. The apparatus of claim 26, wherein the tubular body further comprises an injection port disposed through the wall of the tubular body and between the first and second sealing member for filling the apparatus with a material to be set prior to deployment downhole.

28. The apparatus of claim 27, wherein the sealing members comprise a cylindrical piston that seals against the inner surface of the top portion of the tubular body.

29. The apparatus of claim 28, wherein the sealing members further comprises a plurality of o-rings for maintaining the seal between the sealing members and the inner surface of the top portion of the tubular body.

30. The apparatus of claim 29, wherein the bottom portion of the bottom section further comprises a plurality of windows through which the material to be set within a zone of interest is transferred from between the first and second sealing member, into the bore of the tubular body of the bottom section, and through the plurality of windows into the zone of interest.

31. The apparatus of claim 30 further comprising a bull nose disposed below bottom section for guiding the placement of the apparatus into a wellbore.

32. A method of setting a material into a zone of interest within a well bore, the method comprising the steps of:

providing an apparatus for setting the material into a zone of interest within a welibore, the apparatus comprising:

a top section having a means for transferring electrical power from a surface power supply through the top section;

a reversible motor coupled to the top section and capable of receiving electrical power from the top section, the motor having a rotational output shaft;

a bottom section having a top portion and a bottom portion, the top portion comprising a sealing member sealing the top portion from the bottom portion;

a reversible means for transferring work from the rotational output shaft to the bottom section capable of moving the sealing member from the top portion of the bottom section into the bottom portion of the bottom section thereby breaking the seal between the top portion and the bottom portion and allowing material to be set within a zone of interest, as well as being capable of moving the sealing member from the bottom portion of the bottom section into the top portion of the bottom section thereby sealing the top portion from the bottom portion after material has been set within a zone of interest;

wherein the top section further comprises a tubular body having a bore defined therethrough and the means for transferring electrical power through the top section comprises an insulating member disposed within the bore of the tubular body, the insulating member having an electrical contact that connects to a positive lead from the surface power supply and a bore therethrough for passage of a negative lead of the surface power supply, and wherein the reversible motor further comprises a positive terminal and a negative terminal that are connected to the electrical contact and the negative lead, respectively;

wherein the reversible motor rotates in one direction with the application of the surface power supply of a given polarity and rotates in the opposite direction with the application of the surface power supply of an opposite polarity; and wherein the reversible means for transferring work from the rotational output shaft to the bottom section comprises a primary lead screw mechanically coupled to the rotational output shaft of the motor, the primary lead screw having a externally threaded surface, a secondary lead screw having a upper portion comprising a substantially cylindrical body having a bore defined therethrough with an internally threaded surface capable of rotationally engaging the externally threaded surface of the primary lead screw, a bottom portion having an externally threaded surface, the bottom portion coupled to the upper portion such that when the primary lead screw rotates in one direction within the upper portion, the bottom portion of the secondary lead screw moves in an axial direction and when the primary lead screw rotates in the opposite direction within the upper portion, the bottom portion of the secondary lead screw moves in the opposite axial direction, and a coupling means connecting the bottom portion of the secondary lead screw to the bottom section such that the axial motion of the bottom portion in one direction moves the sealing member from the top portion of the bottom section into the bottom portion of the bottom section and the axial motion of the bottom portion in the opposite direction moves the sealing member from the bottom portion of the bottom section into the top portion of the bottom section;

depositing the material to be set between the top section and the bottom section;

deploying the apparatus into a well bore where the bottom section of the apparatus is placed within the zone of interest;

applying a source of pressure from the surface to the apparatus and onto the material between the top section and the bottom section;

applying power from the surface power supply to the motor causing the movement of the sealing member and breaking of the seal between the top portion and bottom portion of the bottom section; and allowing the material between the top section and bottom section to flow through the top portion of the bottom section. into the bottom portion of the bottom section and into the zone of interest.

33. The method of claim 32, wherein the reversible means for transferring work from the rotational output shaft to the bottom section further comprises a plurality of extension rods connecting the bottom portion of the secondary lead screw to the bottom section which maintains a volume of space between the top section and bottom section for holding the material to be set within a zone of interest.

34. The method of claim 33, wherein the tubular body of the top section further comprises a plurality of windows through which the material to be set within a zone of interest is transferred from the surface through the plurality of windows and into bore of the tubular body.

35. The method of claim 34, wherein the bottom section further comprises a tubular body having a bore defined therethrough, the tubular body having a top portion and a bottom portion, the top portion of the tubular body housing the sealing member.

36. The method of claim 35, wherein the sealing member comprises a cylindrical piston that seals against the inner surface of the top portion of the tubular body.

37. The method of claim 36, wherein the sealing member further comprises a plurality of o-rings for maintaining the seal between the sealing member and the inner surface of the top portion of the tubular body.

38. The method of claim 37, wherein the bottom portion of the bottom section further comprises a plurality of windows through which the material to be set within a zone of interest is transferred from above the bottom section through the top portion, into the bore of the tubular body of the bottom section, and through the plurality of windows into the zone of interest.

39. The method of claim 38, further comprising a bull nose disposed below bottom section for guiding the placement of the apparatus into a wellbore.

40. A method of setting a material into a zone of interest within a well bore, the method comprising the steps of:

providing an apparatus for setting the material into a zone of interest within a wellbore, the apparatus comprising:

a top section having a means for transferring electrical power from a surface power supply through the top section;

a reversible motor coupled to the top section and capable of receiving electrical power from the top section the motor having a rotational output shaft;

a bottom section having a top portion and a bottom portion, the top portion comprising a sealing member sealing the top portion from the bottom portion;

a reversible means for transferring work from the rotational output shaft to the bottom section capable of moving the sealing member from the top portion of the bottom section into the bottom portion of the bottom section thereby breaking the seal between the top portion and the bottom portion and allowing material to be set within a zone of interest, as well as being capable of moving the sealing member from the bottom portion of the bottom section into the top portion of the bottom section thereby sealing the top portion from the bottom portion after material has been set within a zone of interest; and wherein the reversible means for transferring work from the rotational output shaft to the bottom section comprises a primary lead screw mechanically coupled to the rotational output shaft of the motor, the primary lead screw having an externally threaded surface; a secondary lead screw comprising a cylindrical body having atop end, a bottom end, and a bore defined therethrough, the bore having an internally threaded surface, the top end of the cylindrical body capable of engaging the primary lead screw, and the bottom end coupled to the sealing member; and a guide cage in communication with the external surface of the secondary lead screw, the guide cage capable of preventing rotation of the secondary lead screw as the primary lead screw rotates causing the secondary lead screw to move in an axial direction as the primary lead screw rotates and the axial motion of the secondary lead screw causing axial motion of the sealing member;

depositing the material to be set between the top section and the bottom section;

deploying the apparatus into a well bore where the bottom section of the apparatus is placed within the zone of interest;

applying power from the surface power supply to the motor causing the movement of the sealing member and breaking of the seal between the top portion and bottom portion of the bottom section; and allowing the material between the top section and bottom section to flow through the top portion of the bottom section into the bottom portion of the bottom section and into the zone of interest.

41. The apparatus of claim 40, wherein the reversible means for transferring work from the rotational output shaft to the bottom section further comprises a plurality of extension rods connecting the bottom end of the secondary lead screw to the bottom section which maintains a volume of space between the top section and bottom section for holding the material to be set within a zone of interest.

42. The method of claim 41, wherein the bottom section further comprises a tubular body having a bore defined therethrough, the tubular body having a top portion and a bottom portion, the top portion of the tubular body housing the sealing member.

43. The method of claim 42, wherein the sealing member comprises a cylindrical piston that seals against the inner surface of the top portion of the tubular body.

44. The method of claim 43, wherein the sealing member further comprises a plurality of o-rings for maintaining the seal between the sealing member and the inner surface of the top portion of the tubular body.

45. The method of claim 44, wherein the bottom portion of the bottom section further comprises a plurality of windows through which the material to be set within a zone of interest is transferred from above the bottom section through the top portion, into the bore of the tubular body of the bottom section, and through the plurality of windows into the zone of interest.

46. The apparatus of claim 45, further comprising a bull nose disposed below bottom section for guiding the placement of the apparatus into a wellbore.

47. A method of setting two or more materials into a zone of interest within a wellbore, the method comprising the steps of:

providing an apparatus for setting the two or more materials into a zone of interest within a wellbore, the apparatus comprising:

a top section having a means for transferring electrical power from a surface power supply through the top section;

a reversible motor coupled to the top section and capable of receiving electrical power from the top section. the motor having a rotational output shaft;

a first bottom section having a top portion and a bottom portion, the top portion comprising a sealing member sealing the top portion from the bottom portion;

a second bottom section disposed below the first bottom section, the second bottom section having a top portion and a bottom portion, the top portion comprising a sealing member sealing the top portion from the bottom portion;

a reversible means for transferring work from the rotational output shaft to the first and second bottom sections capable of moving the sealing members from the top portions of the bottom sections into the bottom portions of the bottom sections thereby breaking the seals between the top portions and the bottom portions and allowing material to be set within a zone of interest, as well as being capable of moving the sealing members from the bottom portions of the bottom sections into the top portions of the bottom sections thereby sealing the top portions from the bottom portions after material has been set within a zone of interest;

wherein the top section further comprises a tubular body having a bore defined therethrough and the means for transferring electrical power through the top section comprises an insulating member disposed within the bore of the tubular body, the insulating member having an electrical contact that connects to a positive lead from the surface power supply and a bore therethrough for passage of a negative lead of the surface power supply, and wherein the reversible motor further comprises a positive terminal and a negative terminal that are connected to the electrical contact and the negative lead, respectively;

wherein the reversible motor rotates in one direction with the application of the surface power supply of a given polarity and rotates in the opposite direction with the application of the surface power supply of an opposite polarity; and wherein the reversible means for transferring work from the rotational output shaft to the bottom section comprises a primary lead screw mechanically coupled to the rotational output shaft of the motor, the primary lead screw having an externally threaded surface; a secondary lead screw comprising a cylindrical body having atop end, a bottom end, and a bore defined therethrough, the bore having an internally threaded surface, the top end of the cylindrical body capable of engaging the primary lead screw, and the bottom end coupled to the sealing members; and a guide cage in communication with the external surface of the secondary lead screw, the guide cage capable of preventing rotation of the secondary lead screw as the primary lead screw rotates causing the secondary lead screw to move in an axial direction as the primary lead screw rotates and the axial motion of the secondary lead screw causing axial motion of the sealing members;

depositing the first material to be set between the top section and the first bottom section;

depositing the second material to be set between the first bottom section and the second bottom section;

deploying the apparatus into a well bore where the first and second bottom sections of the apparatus are placed within the zone of interest;

applying power from the surface power supply to the motor causing the movement of the sealing members and breaking of the seal between the top portions and bottom portions of the first and second bottom sections; and allowing the first material between the top section and first bottom section and the second material between the first bottom section and second bottom section to flow through the top portions of the bottom sections, into the bottom portions of the bottom sections and into the zone of interest.

48. The method of claim 47, wherein the reversible means for transferring work from the rotational output shaft to the first and second bottom section further comprises a plurality of extension rods connecting the bottom portion of the secondary lead screw to the first bottom section which maintains a volume of space between the top section and first bottom section for holding the first material to be set within a zone of interest, and a plurality of extension rods connecting the first bottom section to the second bottom section which maintains a volume of space between the first bottom section and the second bottom section for holding the second material to be set within a zone of interest.

49. The method of claim 48, wherein the first and second bottom sections further comprise tubular bodies having a bore defined therethrough, the tubular bodies having a top portion and a bottom portion, the top portion of the tubular bodies housing the sealing members.

50. The method of claim 49, wherein the sealing members comprise a cylindrical piston that seals against the inner surfaces of the top portions of the tubular bodies.

51. The method of claim 50, wherein the sealing members further comprise a plurality of o-rings for maintaining the seals between the sealing members and the inner surfaces of the top portions of the tubular bodies.

52. The method of claim 51, wherein the bottom portions of the bottom sections further comprise a plurality of windows through which the first and second material to be set within a zone of interest is transferred into the bore of the tubular bodies of the bottom sections, and through the plurality of windows into the zone of interest.

53. The method of claim 52, further comprising a bull nose disposed below the second bottom section for guiding the placement of the apparatus into a wellbore.

* * * * *